US012740674B2

(12) United States Patent
Enmalm et al.

(10) Patent No.: US 12,740,674 B2
(45) Date of Patent: Sep. 22, 2026

(54) OUTLET ASSEMBLY FOR A DISPENSER FOR WEB-SHAPED ABSORBENT MATERIAL

(71) Applicant: Essity Hygiene and Health Aktiebolag, Gothenburg (SE)

(72) Inventors: Johanna Enmalm, Borlänge (SE); Antonio Källgren, Borlänge (SE); Marcus Kullman, Borlänge (SE); Susanne Gungner, Gothenburg (SE); Tomas Gandemo, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 18/851,512

(22) PCT Filed: Mar. 31, 2022

(86) PCT No.: PCT/EP2022/058599
§ 371 (c)(1),
(2) Date: Sep. 26, 2024

(87) PCT Pub. No.: WO2023/186311
PCT Pub. Date: Oct. 5, 2023

(65) Prior Publication Data

US 2025/0213077 A1 Jul. 3, 2025

(51) Int. Cl.
*A47K 10/38* (2006.01)
*A47K 10/32* (2006.01)

(52) U.S. Cl.
CPC .. *A47K 10/3818* (2013.01); *A47K 2010/3233* (2013.01)

(58) Field of Classification Search
CPC ..... A47K 10/3818
(Continued)

(56) References Cited

U.S. PATENT DOCUMENTS 5,141,171 A 8/1992 Yang
5,263,607 A * 11/1993 Temesvary ..... B65D 83/0805 225/106
(Continued)

FOREIGN PATENT DOCUMENTS

CN 102905593 A 1/2013
CN 103025219 A 4/2013
(Continued)

OTHER PUBLICATIONS

International Search Report (PCT/ISA/210) and Written Opinion (PCT/ISA/237) mailed on Jun. 16, 2023, by the European Patent Office as the International Searching Authority for International Application No. PCT/EP2023/058026. (10 pages).
(Continued)

*Primary Examiner* — William A. Rivera
(74) *Attorney, Agent, or Firm* — BUCHANAN INGERSOLL & ROONEY PC

(57) ABSTRACT

An outlet assembly for arrangement to an outer wall of a dispenser for web-shaped absorbent material, the outlet assembly comprises a first part defining a first outlet portion and a second part defining a second outlet portion wherein the first part comprises a rim attachment element such that the first part assumes a first part fixed position in relation to the wall opening outer rim, the first part further comprises a first connector element, and the second part comprises a second connector element, the first connector element and the second connector element being such that the second part can be attached to the first part by means of connection between the first connector element and the second connector element such that the second part assumes a second part fixed position in relation to the first part.

25 Claims, 6 Drawing Sheets

(58) Field of Classification Search
USPC ..... 242/593
See application file for complete search history.

(56) References Cited

U.S. PATENT DOCUMENTS

| | | | | |
|---|---|---|---|---|
| 11,172,794 | B2 | 11/2021 | Kim | |
| 2007/0235494 | A1 | 10/2007 | Foran et al. | |
| 2012/0175455 | A1 | 7/2012 | Denis et al. | |
| 2013/0105614 | A1 | 5/2013 | Hjort et al. | |
| 2013/0306669 | A1* | 11/2013 | Ray | A47K 10/3818 221/63 |
| 2015/0122937 | A1* | 5/2015 | Marietta-Tondin | A47K 10/3818 242/593 |
| 2015/0313425 | A1 | 11/2015 | Thorn et al. | |
| 2016/0000276 | A1* | 1/2016 | Rozek | A47K 10/3818 242/593 |
| 2020/0038921 | A1 | 2/2020 | Vadstrup | |
| 2020/0375414 | A1 | 12/2020 | Albrecht | |
| 2021/0093128 | A1* | 4/2021 | Mann | A47K 10/44 |
| 2022/0225848 | A1* | 7/2022 | Gandemo | A47K 10/3818 |
| 2022/0313030 | A1 | 10/2022 | Elliott et al. | |
| 2024/0285131 | A1* | 8/2024 | Chen | A47K 10/3818 |

FOREIGN PATENT DOCUMENTS

| | | | | |
|---|---|---|---|---|
| CN | 104853661 | A | | 8/2015 |
| CN | 110520360 | A | | 11/2019 |
| CN | 114007475 | A | | 2/2022 |
| CN | 114173623 | A | | 3/2022 |
| EP | 3 040 005 | | * | 11/2015 |
| EP | 3818918 | A1 | | 5/2021 |
| WO | WO 2023/186913 | | * | 10/2023 |

OTHER PUBLICATIONS

Notification of Transmittal of the International Preliminary Report on Patentability (PCT/IPEA/409) mailed on Jun. 5, 2024, by the European Patent Office as the International Preliminary Examining Authority for International Application No. PCT/EP2023/058026. (14 pages).

Office Action (Communication) issued on Oct. 28, 2025, by the European Patent Office in corresponding European Patent Application No. 23 714 561.0. (5 pages).

The Examiner's attention is directed to co-pending U.S. Appl. No. 18/849,172, filed Sep. 20, 2024, inventors Mattias Bengtsson et al.

International Search Report (PCT/ISA/210) and Written Opinion (PCT/ISA/237) mailed Nov. 7, 2022, by the European Patent Office as the International Searching Authority for International Application No. PCT/EP2022/058599. (9 pages).

Office Action (Notification of the First Office Action) issued on Jan. 17, 2026, by the Chinese Patent Office in corresponding Chinese Patent Application No. 202380023630.8, and an English Translation of the Office Action. (11 pages).

Office Action (Notification of the First Office Action) issued on Jan. 20, 2026, by the Chinese Patent Office in corresponding Chinese Patent Application No. 202280092568.3, and an English Translation of the Office Action. (25 pages).

Office Action (Notification of the Second Office Action) issued on Jun. 25, 2026, by the Chinese Patent Office in corresponding Chinese Patent Application No. 202280092568.3, and an English Translation of the Office Action. (24 pages).

Office Action (Notice of Completing Formalities for Patent Registration) issued on Jun. 2, 2026, by the Chinese Patent Office in corresponding Chinese Patent Application No. 202380023630.8, and an English Translation of the Office Action. (8 pages).

* cited by examiner

OUTLET ASSEMBLY FOR A DISPENSER FOR WEB-SHAPED ABSORBENT MATERIAL

TECHNICAL FIELD

The invention relates to an outlet assembly for a dispenser for web-shaped absorbent material. The invention further relates to method of assembling such an outlet assembly, and to a dispenser comprising the outlet assembly.

BACKGROUND

Dispensers for dispensing web-shaped tissue material for wiping or cleaning purposes are widely used. Web-shaped tissue material such as paper tissue material or nonwoven material come in a variety of shapes and sizes. Typically, the web-shaped tissue material may be provided in the form of a folded stack or in the form of a roll.

For example, for some applications, it is desired to provide the web-shaped tissue material in the form of a centrefeed roll, i.e. a roll where it is intended to feed the web material from the centre of the roll, i.e. by pulling the web material in a direction at least partly parallel to the roll dispensing axis.

The web-shaped absorbent material may for example be perforated web-shaped absorbent material, where perforation lines arranged transverse the length of the web divide the web-shaped absorbent material into individual products.

Dispensers for dispensing perforated web-shaped absorbent materials may be provided with a dispensing element, such as a nozzle, adapted to ensure that the web shaped tissue material is separated along the perforation lines when dispensed. As such, the dispenser may provide for one-by-one product dispensing of individual products.

However, since it may sometimes be desired to provide for one-by-one product dispensing, whereas it is sometimes instead desired to provide for continuous dispensing of the web-shaped absorbent material, i.e. free flow dispensing, different dispensers having different dispensing outlets with e.g. different nozzles may be provided to meet the various needs.

For reasons of efficiency and versatility, there is a desire to use the same dispenser with different dispensing outlets. As such, one dispenser may be used for example either for one-by-one dispensing or for free flow dispensing, depending on the dispensing outlet used.

Further, to enable easy replacement of a dispensing outlet of a dispenser, it is required that the dispensing outlet may be arranged to the dispenser in a time efficient manner, while ensuring that the dispensing outlet is properly positioned at and arranged to the dispenser, such that the dispensing function is ensured.

For example, for dispensers already installed in e.g. in a range of public restrooms, there may be a need to replace one or more of the existing outlets of the dispensers, for example due to wear or due to a change of the type of web-shaped tissue material to be dispensed. In this case, it is generally not desired to remove the existing dispensers from their fixed positions in the restrooms. For example, each dispenser may be fixed to a vertical wall of a restroom. In these circumstances, there are no possibilities for the person performing the arrangement or replacement of the outlet assemblies to the dispensers to move the dispensers around to achieve a convenient working position. Instead, the person must work with the dispenser in the orientation as fixed to the wall. In some situations, this may imply arranging the dispensing outlet to a generally vertical outer wall of the dispenser.

Thus, there is a need to enable easy arrangement of a dispensing outlet to an outer wall of a dispenser when the dispenser is in a fixed orientation, such as for example to enable easy arrangement of a dispensing outlet to an outer wall of a dispenser extending in a generally vertical direction.

In view of the above, there is a need for an improvement or an alternative when it comes to providing a dispenser with the option of different dispensing outlets.

SUMMARY

An object of the invention is to provide a solution which fulfils one or more of the above-mentioned needs.

In a first aspect, the object is achieved by an outlet assembly for arrangement to an outer wall of a dispenser for web-shaped absorbent material, the outer wall defining a wall opening extending along an outlet axis through the wall, the wall opening having a wall opening rim, and the outlet assembly being adapted to form an outlet for dispensing of the web-shaped absorbent material from the dispenser through the wall opening in a direction along the outlet axis, wherein the outlet assembly comprises a first part defining a first outlet portion extending along a dispensing axis of the first part;

and a second part defining a second outlet portion extending along a dispensing axis of the second part. Further, the first part comprises a rim attachment element being such that the first part can be attached to the wall opening rim by means of the rim attachment element such that the first part assumes a first part fixed position in relation to the wall opening outer rim, wherein the dispensing axis of the first outlet portion extends along the outlet axis. The first part further comprises a first connector element, and the second part comprises a second connector element, the first connector element and the second connector element being such that the second part can be attached to the first part when in the first part fixed position by means of connection between the first connector element and the second connector element such that the second part assumes a second part fixed position in relation to the first part, wherein the dispensing axis of the second outlet portion extends along the dispensing axis of the first outlet portion such that, when the first part is in the first part fixed position in relation to the wall opening rim, and the second part is in the second part fixed position in relation to the first part, the first outlet portion and the second outlet portion form the outlet for dispensing of the web-shaped absorbent material from the dispenser through the wall opening in a direction along the outlet axis.

Optionally, the dispenser wall has a first side and a second side opposite the first side, and the rim attachment element is such that the first part can be brought to the first part fixed position from the first side of the dispenser wall, and the first and second connector elements are such that the second part can be brought to the second part fixed position from the second side of the dispenser wall.

Optionally, the first part and the second part are such that, when the first part is in the first part fixed position in relation to the wall opening rim, and the second part is in the second part fixed position in relation to the first part, at least a portion of the wall opening rim is positioned between the first part and the second part.

Optionally, the first part comprises a first fastening bore extending in a direction along the dispensing axis of the first part, and the second part comprises a second fastening bore extending in a direction along the dispensing axis of the second part, and, when the second part is in the second part fixed position, the first and second fastening bores are aligned in a direction along the dispensing axis of the first and second parts, allowing insertion of a fastening member though the first and second fastening bores.

Optionally, the first part further comprises a bracket member extending about the second outlet portion in a length direction and in a width direction, the length direction and the width direction being perpendicular to the dispensing axis of the first part.

Optionally, the bracket member may be forming a wall portion.

Optionally, the bracket member is adapted to extend in the length direction and the width direction so as extend over at least a part of the wall opening rim, such as the entire wall opening rim, when the first part is in the first part fixed position.

Optionally, the first part defines one or more protruding portions protruding in a direction along the dispensing axis of the first part from the bracket, wherein the one or more protruding portions comprises the rim attachment element and/or the first connector element, and/or, when the first part comprises a fastening bore, the first fastening bore.

Optionally, the first part is configured such that the bracket member is adapted to be arranged on the first side of the dispenser wall being the outside of the dispenser wall.

Optionally, the second part comprises a nozzle portion forming the second outlet portion.

Optionally, the second part is configured such that the nozzle portion is adapted to be arranged on the second side of the dispenser wall being the inside of the dispenser wall.

Optionally, the first part is such that the first part is movable by one or more attachment steps from an initial state where the first part is unattached to the wall opening rim to the first part fixed position.

Optionally, the first part is configured in relation to the wall opening rim so as to be guided towards the first part fixed position during at least one of the one or more attachment steps.

Optionally, the first part is such that the first part is movable in a first attachment step from an initial state where the first part is unattached to the wall opening rim to a predetermined intermediate position at or adjacent the wall opening rim, and in a second attachment step from the predetermined intermediate position to the first part fixed position.

Optionally, the first part is configured in relation to the wall opening rim so as to be guided towards the first part fixed position during the second attachment step.

Optionally, the first part is such that, in the first attachment step, the first part is movable along the outlet axis only when the first part assumes an angular position in relation to the outlet axis being in a first range of angular positions about the outlet axis Optionally, the rim attachment element is such that, in the second attachment step, the first part is movable from the predetermined intermediate position to the first part fixed position by rotation around the outlet axis.

With "by rotation" is meant herein that a part is movable by movement in a rotational direction around an axis. The rotation may extend over any number of degrees around the outlet axis, i.e. "by rotation" does not necessarily imply the part is movable by 360 degrees around an axis.

For example, the first part may be movable from the predetermined intermediate position to the first part fixed position by rotation around the outlet axis, where the rotation is no more than 360 degrees, such as no more than 180 degrees or no more than 90 degrees. The rotation may be for example greater than 10 degrees.

Optionally, the wall opening rim comprises engagement members and the rim attachment element is adapted for engagement with the engagement members.

Optionally, the first part and the second part are such that the second part is movable by one or more attachment steps from an initial state where the second part is unattached to the first part to the second part fixed position.

Optionally, the second part is configured in relation to the first part so as to be guided towards the second part fixed position during at least one of the one or more attachment steps.

Optionally, the second part and the first part are such the second part is movable in a first attachment step from an initial state where the second part is unattached to the first part to a predetermined intermediate position at or adjacent the first part, and in a second attachment step from the predetermined intermediate position to the second part fixed position.

Optionally, the second part is configured in relation to the first part so as to be guided towards the first part fixed position during the second attachment step.

Optionally, the second part and the first part are such that, in the first attachment step, the second part is movable in a direction at least partly along the dispensing axis of the first part only when the second part is in a first range of angular positions about the dispensing axis of the first part.

For example, the first range of angular positions may be no more than 180 degrees, such as no more than 90 degrees or no more than 45 degrees. The first range of angular positions may for example be greater than 10 degrees. For example the first range of angular positions may be from 10 to 90 degrees, such as from 10 to 45 degrees.

Optionally, the first part and the second part are such that the second part is movable from the predetermined intermediate position to the second part fixed position by rotation of the second part about the dispensing axis of the first part.

For example, the second part may be movable from the predetermined intermediate position to the second part fixed position by rotation of the second part about the dispensing axis of the first part, where the rotation is no more than 360 degrees, such as no more than 180 degrees or no more than 90 degrees. The rotation may be for example greater than 10 degrees.

Optionally, the first connector element and the second connector element are adapted to engage by abutment in a direction along the dispensing axis of the first part, when the second part is in the second part fixed position in relation to the first part.

In a second aspect the object is achieved by a kit for an outlet assembly comprising at least one first part and at least two second parts, wherein each of the two second parts is attachable to the one first part to form an outlet assembly in accordance with the first aspect, and wherein the second outlet portions of the two second parts differ from each other.

Optionally, the second outlet portion of one of the second parts is adapted for one-by-one dispensing of web-shaped absorbent material, and the second outlet portion of another of the second parts is adapted for uninterrupted dispensing of the same web-shaped absorbent material.

In a third aspect the object is achieved by a dispenser comprising an outer wall defining a wall opening extending along an outlet axis through the wall, the wall opening having a wall opening rim, and the dispenser further comprising an outlet assembly according to the first aspect.

In a fourth aspect the object is achieved by a method for arranging an outlet assembly according to the first aspect to an outer wall of a dispenser for web-shaped absorbent material, the outer wall defining a wall opening extending along an outlet axis through the outer wall, and the wall opening having a wall opening rim, the method comprising:

Moving the first part from an initial state unattached to the wall opening rim to the first part fixed position in relation to the wall opening rim by one or more attachments steps; and Moving the second part from an initial state unattached to the first part to the second part fixed position in relation to the first part by one or more attachment steps.

Optionally, the method further comprises the step of fastening the first part and the second part when in the first and second part fixed positions, respectively, using a fastening member.

Optionally, the step of moving the first part from an initial state unattached to the wall opening rim to the first part fixed position comprises A first attachment step comprising moving the first part from the initial state to a predetermined intermediate position adjacent or at the wall opening rim; and A second attachment step comprising moving the first part from the predetermined intermediate position to the first part fixed position.

Optionally, the step of moving the second part from an initial state unattached to the first part to the first part fixed position comprises a first attachment step comprising moving the second part from the initial state to a predetermined intermediate position adjacent or at first part by a first movement in at least a first direction; and a second attachment step comprising moving the second part from the predetermined intermediate position to the first part fixed position by a second movement in at least a second direction, different from the first direction.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

Figure 1:
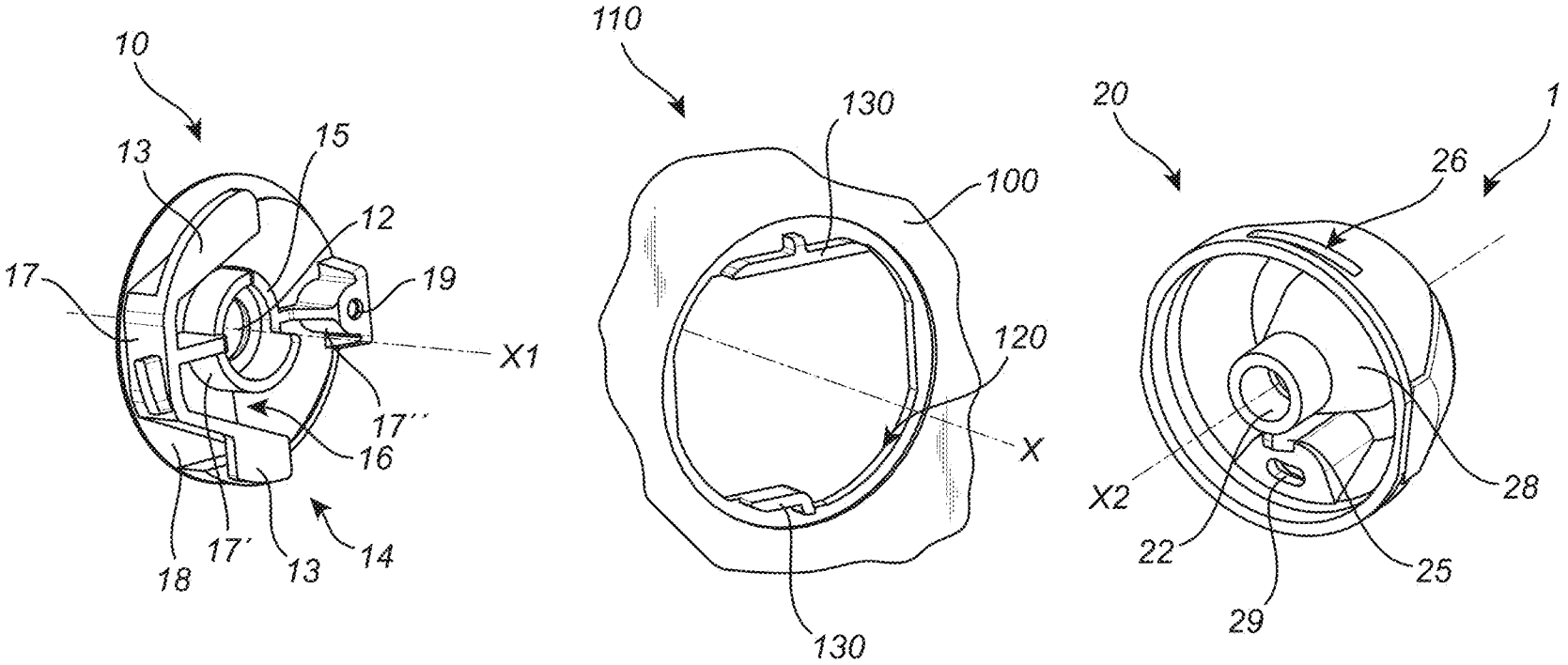
FIG. 1 is a perspective view of a variant of an outlet assembly comprising a first part 10 and a second part 20, together with a wall opening 110 in a wall 100 of a dispenser.

Reference numerals indicate the same features throughout the figures. In some drawings, some reference numerals are omitted for the sake of clarity.

DETAILED DESCRIPTION OF EXAMPLE EMBODIMENTS OF THE INVENTION

FIG. 1 illustrates an example of an outlet assembly 1 for arrangement to an outer wall 100 of a dispenser 1000 (see FIGS. 4*a* to 4*b*) for web-shaped absorbent material.

The dispenser may comprise a storage compartment configured for housing a supply of web-shaped absorbent material. The supply of web-shaped absorbent material may be in the form of a stack or a roll. The outlet assembly as described herein may be useful for different types of dispensers. However, the outlet assembly as described herein may be particularly advantageous for use with a dispenser which is adapted for holding a supply of web-shaped absorbent material in the form of a centre-feed roll, i.e. a roll where the web-shaped material is to be dispensed from the centre of the roll. The outlet assembly as described herein may be arranged to an outer wall of the dispenser so as to provide a dispensing outlet enabling dispensing of web-shaped absorbent material from the supply of web-shaped absorbent material to the exterior of the dispenser via the dispensing outlet.

The web-shaped absorbent material may be any web-shaped material intended for wiping or cleaning purposes as outlined in the above, such as paper material or nonwoven material. For example, the web-shaped absorbent material may be a disposable material, i.e. a material intended to be used only once or a few times and then discarded. The web-shaped absorbent material may be recyclable. For example, the web-shaped absorbent material may be a toilet paper material or a paper towel material.

Figure 4B:
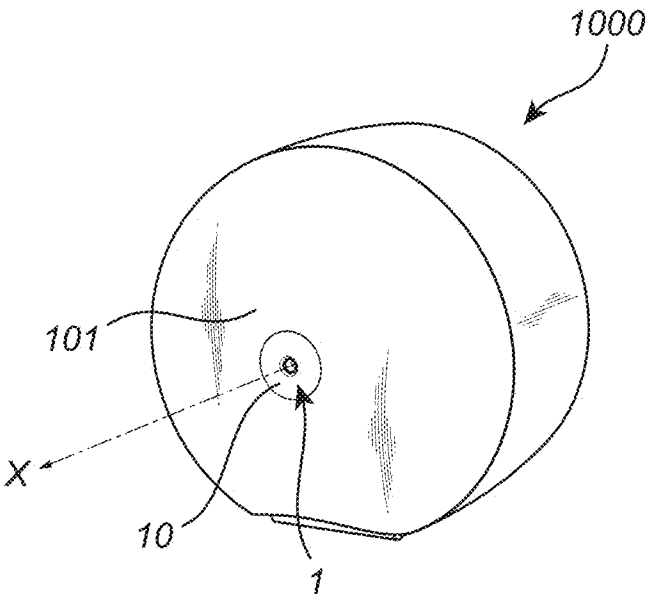
FIGS. 4*a* and 4*b* illustrate a dispenser 1000 with the outlet assembly 1 of FIG. 1, in an open and a closed state, respectively.
Figure 4A:
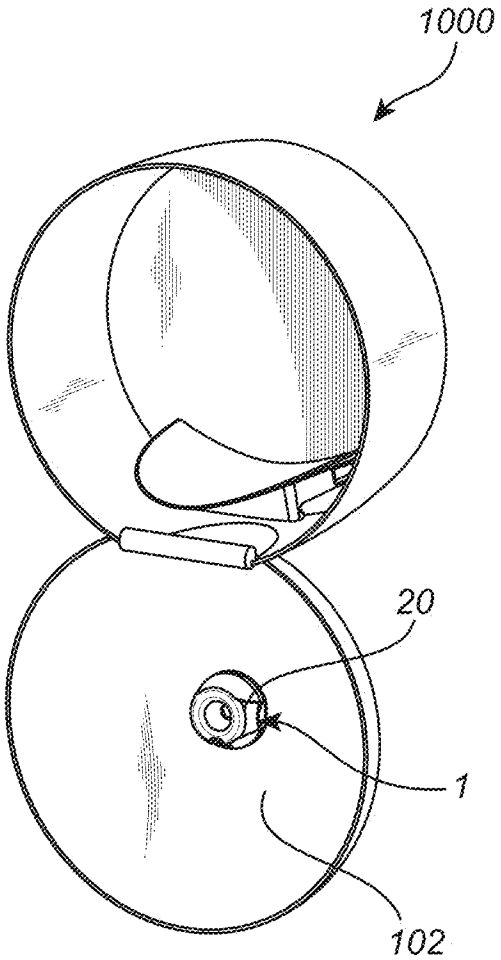

The outer wall to which the outlet assembly is to be arranged may be any outer wall of the dispenser. However, the outlet assembly as described herein provides the advantage of easy attachment to an outer wall which extends primarily along a vertical direction, when the outer wall is in a position suitable for attaching or replacing the outlet assembly of a dispenser. For example, and as in the dispenser 1000 illustrated in FIGS. 4*a* and 4*b*, the outer wall 100 may be in the form of a cover being movable from a cover being movable between an open state of the dispenser 1000 as illustrated in FIG. 4*a* and a closed state of the dispenser 1000 as illustrated in FIG. 4*b*.

As illustrated in FIG. 1, the outer wall 100 defines a wall opening 110 extending along an outlet axis X through the wall 100 and having a wall opening rim 120. The size and shape of the wall opening 110 may be adapted to enable the arrangement of the outlet assembly 1 which is to form an outlet for dispensing of web-shaped absorbent material from the dispenser 1000 through the wall opening 110 in a direction along the outlet axis X.

With the term "in a direction along an axis" is meant herein that the direction has at least a component along the axis. For example, the direction may have its largest component directed along the axis. For example, the direction may be substantially parallel to the axis. The above-mentioned examples apply to all uses of the term "in a direction along an axis" in this application.

The outlet assembly 1 comprises a first part 10 defining a first outlet portion 12 extending along a dispensing axis X1 of the first part 10; and a second part 20 defining a second outlet portion 22 extending along a dispensing axis X2 of the second part 20.

The first part 10 comprises a rim attachment element 14 being such that the first part 10 can be attached to the wall opening rim 120 by means of the rim attachment element 14 such that the first part 10 assumes a first part fixed position in relation to the wall opening outer rim 120, wherein the dispensing axis X1 of the first outlet portion 12 extends in a direction along the outlet axis X. For example, and as in the illustrated variant, the dispensing axis X1 of the first outlet portion 12 may extend in parallel with the outlet axis X. For example, and as illustrated, the dispensing axis X1 of the first outlet portion 12 may coincide with the outlet axis X, when the first part 10 is in the first part fixed position.

The first part 10 further comprises a first connector element 16, and the second part 20 comprises a second connector element 26, the first connector element 16 and the second connector element 26 being such that the second part 20 can be attached to the first part 10 when the first part 10 is in the first part fixed position by means of connection between the first connector element 16 and the second connector element 26, such that the second part 20 assumes a second part fixed position in relation to the first part 10, wherein the dispensing axis X2 of the second outlet portion 22 extends in a direction along the dispensing axis X1 of the first outlet portion 12. For example, and as in the illustrated variant, the dispensing axis X2 of the second outlet portion 22 may extend in parallel with the dispensing axis X1 of the first outlet portion 12. For example, and as illustrated, the dispensing axis X2 of the second outlet portion 22 may coincide with the dispensing axis X1 of the first outlet portion 12, when the second part 20 is in the second part fixed position.

Thus, the first part 10 and the second part 20 are such that when the first part 10 is in the first part fixed position in relation to the wall opening rim 120, and the second part 20 is in the second part fixed position in relation to the first part 10, the first outlet portion 12 and second outlet portion 22 form the outlet for dispensing of the web-shaped absorbent material from the dispenser through the wall opening 110 in a direction along the outlet axis X.

By "fixed position" is meant herein a position which is fixed such that the part being in the fixed position is maintained in the position without need for any external support, regardless of the orientation of the wall 100 with the wall opening 110. As such, when the first part 10 is in the first part fixed position in relation to the wall opening rim 120, this means that the first part 10, if left without any external support, will be maintained in the first part fixed position. That is, the first part 10 is supported by the wall opening rim 120. Similarly, when the second part 20 is in the second part fixed position in relation to the first part 10, this means that the second part 10, if left without any external support and regardless of the orientation of the wall 100 with the wall opening 110, will be maintained in the first part fixed position. That is, the second part 20 is supported by the first part 10.

The above implies that the arrangement of the outlet assembly 1 to the wall 100 of the dispenser 1000 comprising the wall opening 110 may be made in a first step comprising moving the first part 10 from an initial state unattached to the wall opening rim 120 to the first part fixed position in relation to the wall opening rim; and a second step comprising moving the second part 20 from an initial state unattached to the first part 10 to the second part fixed position in relation to the first part 10.

Hence, when performing the second step of attaching the second part 20 to the first part 10, the first part 10 remains in the first part fixed position without need for external support, which facilitates the arrangement procedure. Similarly, once the second part 20 is attached to the first part 10, the second part 20 remains in the second part fixed position without need for external support, which facilitates any further attachment steps, such as the application of a fastening element for securing the second part 20 to the first part 10, and/or the securing of the first part 10 to the wall 100. As such, the outlet assembly 1 may conveniently be arranged to the wall 100 of the dispenser 1000 comprising the wall opening 110 regardless of the orientation of the wall. For example, the outlet assembly 1 may conveniently be arranged to a wall 100 extending in a generally vertical direction.

Optionally, and as in the illustrated variant, the first part 10 comprises a first fastening bore 19 extending in a direction along the dispensing axis X1 of the first part 10, and the second part 20 comprises a second fastening bore 29 extending in a direction along the dispensing axis X2 of the second part 20. The first part 10 and the second part 20 may be such that, when the second part 20 is in the second part fixed position, the first and second fastening bores 19, 29 are aligned in a direction along the dispensing axes X1, X2 of the first and second parts 10, 20, allowing the insertion of a fastening member (not shown) though the first and second fastening bores 19, 29.

By means of such a fastening member, the outlet assembly 1 may be secured to the dispenser 100 so as to ensure that the first part 10 and the second part 20 remains in their respective fixed positions also during use of the dispenser 1000 and the outlet assembly 1.

The fastening member may be any type of suitable fastening assembly, such as for example a pin, a bolt, or a screw.

Optionally, and as in the illustrated variant, the dispenser wall 100 has a first side 101 and a second side 102 opposite the first side 101 (see FIGS. 2*a* to 2*e*), and the rim attachment element 14 is such that the first part 10 can be brought to the first part fixed position from the first side 101 of the dispenser wall 100, and the first and second connector elements 16, 26 are such that the second part 20 can be brought to the second part fixed position from the second side 102 of the dispenser wall 100.

As such, the first part 10 and the second part 20 may be such that, when the first part 10 is in the first part fixed position in relation to the wall opening rim 120, and the second part 20 is in the second part fixed position in relation to the first part 10, at least a portion of the wall opening rim 120 is positioned between the first part 10 and the second part 20.

As such, the first part 10 and the second part 20 may both be such that they extend in a direction perpendicular to their respective dispensing axis X1, X2, so as to extend over at least a part of the wall opening rim 120, when in the first fixed position and in the second fixed position, respectively.

For example, the first part 10 may comprise a bracket member 18 extending about the second outlet portion 12 in a length direction L and in a width direction W, the length direction and the width direction L, W being perpendicular to the dispensing axis X1 of the first part 10. The bracket member 18 may be adapted to extend in the length direction L and the width direction W so as extend over at least a part of the wall opening rim 120, when the first part 10 is in the first part fixed position. Thus, the first part 10 may be such that, in the first fixed position, the bracket member 18 extends generally in parallel to the dispenser wall 100. For example, the bracket member 18 may, in the first fixed position, abut the dispenser wall 100 in a direction along the outlet axis X.

For example, and as in the illustrated variant, the first part 10 may define one or more protruding portions 17, 17', 17" protruding in a direction along the dispensing axis X1 of the first part 10 from the bracket member 18. As such, the one or more protruding portions 17, 17', 17" may be adapted to extend through the wall opening 110 when the first part 10 is in the first fixed position with the bracket member 18 residing on e.g. a first side 101 of the dispenser wall 100. As such, the first connector element 16 may be comprised in one or more of the protruding portions 17, 17', 17", such that the second part 20 may be brought to the second part fixed position from the second side 102 of the dispenser wall 102.

In another example, the second part 20 may define one or more protruding portions protruding in a direction along the dispensing axis X2 of the second part 20. As such, the protruding portions may be adapted to extend through the wall opening 110 so as to contact the first part 10 in the first fixed position, for example as outlined in the above with a bracket member 18 residing on the first side wall 101.

Optionally, and as in the illustrated example, the bracket member 18 as outlined in the above is constituted by or comprises a wall portion 18 extending about the second outlet portion 12 in a length direction L and in a width direction W, the length direction and the width direction W, L being perpendicular to the dispensing axis X1 of the first part 10. Thus, the first part 10 may be such that, in the first fixed position, the wall portion extend generally in parallel to the dispenser wall 100. For example, the wall portion 18 may, in the first fixed position, abut the dispenser wall 100 in a direction along the outlet axis X.

Optionally, the wall portion 18 may be adapted to extend in the length direction L and the width direction W so as extend over the entire wall opening rim 120, when the first part 10 is in the first part fixed position. As such, the wall portion 18 may close the majority of the wall opening 110 such that the dispensing opening formed by the first dispensing opening portion 12 and the second dispensing opening portion 22 provides for the only passage between the first side 101 and the second side 102 of the dispenser wall 100 in the area of the wall opening 110.

For example, and as in the illustrated variant, the first part 10 may be configured such that the wall portion 18 is adapted to be arranged on the first side 101, i.e. the outside, of the dispenser wall 100. Thus, and as in the illustrated variant, the wall portion 18 may be adapted to conform to the outside 101 of the dispenser wall 100. Accordingly, the dispenser 1000 as a whole may be provided with a smooth and pleasing exterior appearance.

For example, as in the illustrated variant, and as explained in relation to the bracket member 18 in the above, also when the bracket member 18 is constituted by a wall portion 18, the first part 10 may define one or more protruding portions 17, 17', 17" protruding in a direction along the dispensing axis X1 of the first part 10 from the wall portion 18.

For example, and as in the illustrated variant, the one or more protruding portions 17, 17', 17" may comprise the rim attachment element 14 and/or the first connector element 16, and/or the first fastening bore 19.

As such, the rim attachment element 14 and/or the first connector element 16 and/or the first fastening bore 19 may be arranged so as not to require extension into the wall portion 18 of the first part 10. Accordingly, the wall portion 18 may form a smooth outer surface of the dispenser 1000 as may be desired.

When the first part 10 comprises a wall portion 18 as described in the above, it is understood that the first part 10 and the rim attachment element 14 may be such that the first part 10 can be brought to the first part fixed position from the first side 101, i.e. the outside, of the dispenser wall 100.

Optionally, the first and/or second part 10, 20 may comprise a nozzle portion 28 forming the first and/or second outlet portion 12, 22.

For example, and as in the illustrated variant, the second part 20 may comprise a nozzle portion 28 forming the second outlet portion 22.

A nozzle portion 28 may be a portion having a defined nozzle length in a direction along the dispensing axis X1 of the relevant part 10, 20, so as to form a first and/or second outlet portion 12, 22 having a length being selected to be suitable for the dispensing.

For example, the nozzle portion 28 may be such that the corresponding outlet portion 22, forms a conical outlet path. The nozzle portion 28 may be arranged with the greater diameter of the conical outlet path arranged towards the interior of the dispenser. As such, by adapting e.g. the material forming the outlet path, the length of the outlet path and/or the angle of the conical outlet path, the friction to which the web-shaped material is subject during passage through the outlet path may be controlled. As such, the nozzle portion 28 may for example be adapted so as to enable one-by-one dispensing of a perforated web-shaped absorbent material arranged in the dispenser.

The nozzle portion 28 may, as in the illustrated variant, be adapted to be arranged on the second side 102, i.e. the inside, of the dispenser wall.

For example, and as illustrated, the second part 20 may comprise a nozzle portion 28 forming the second outlet portion 22, and the second part 20 may be configured such that the nozzle portion 28 is to be arranged on the second side 102, i.e. the inside, of the dispenser wall 100 (See FIGS. 3*a* to 3*d*).

Thus, the second part 20 and the first and second connector elements 16, 26 may be such that the second part 20 can be brought to the second part fixed position from the second side 102, i.e. the inside of the dispenser wall 100

As mentioned in the above, and as in the illustrated variant, the first part 10 may be such that the first part 10 is movable by one or more attachment steps from an initial state where the first part 10 is unattached to the wall opening rim 120 to the first part fixed position. Optionally, the first part 10 is configured in relation to the wall opening rim 120 so as to be guided towards the first part fixed position during at least one of the one or more attachment steps. As such, the procedure of arranging the first part 10 in the first part fixed position may be facilitated.

For example, and as illustrated in FIGS. 2*a* to 2*e*, the first part 10 may be such that the first part 10 is movable in a first attachment step from an initial state where the first part 10 is unattached to the wall opening rim 120 to a predetermined intermediate position at or adjacent the wall opening rim 120, and in a second attachment step from the predetermined intermediate position to the first part fixed position, wherein the first part 10 is configured in relation to the wall opening rim 120 so as to be guided towards the first part fixed position during the second attachment step.

Figure 2A:
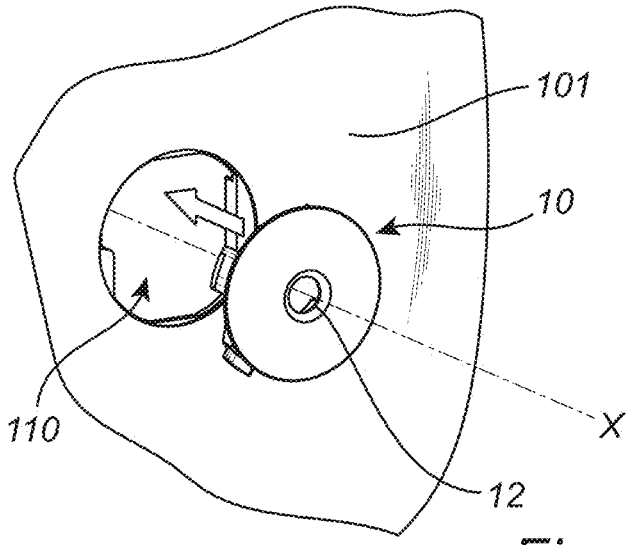
FIGS. 2*a* to 2*e* illustrate the attachment of a first part 10 of FIG. 1 to the wall opening rim 120 of a wall opening 110 in a wall 100 of a dispenser.
Figure 2B:
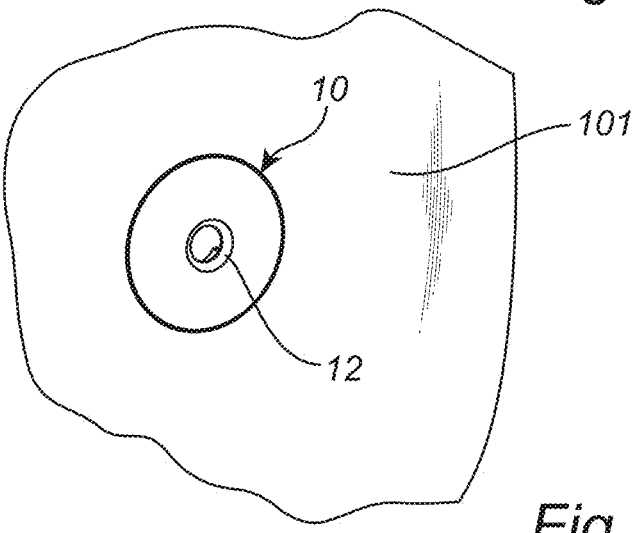
Figure 2C:
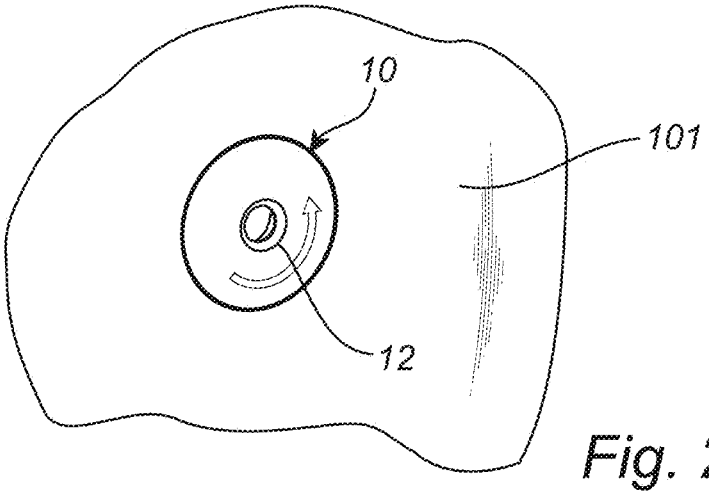

FIG. 2*a* illustrates the first part 10 of the example variant of an outlet assembly 1 of FIG. 1 when in an initial position unattached to the wall opening rim 120, as shown from a first side 101 being an outside of the dispenser wall 100. FIG. 2*b* illustrates the first part 10 when in a predetermined intermediate position at the wall opening rim 120. FIG. 2*c* illustrates the first part 10 when in the first part fixed position relative to the wall opening rim 120.

Figure 2D:
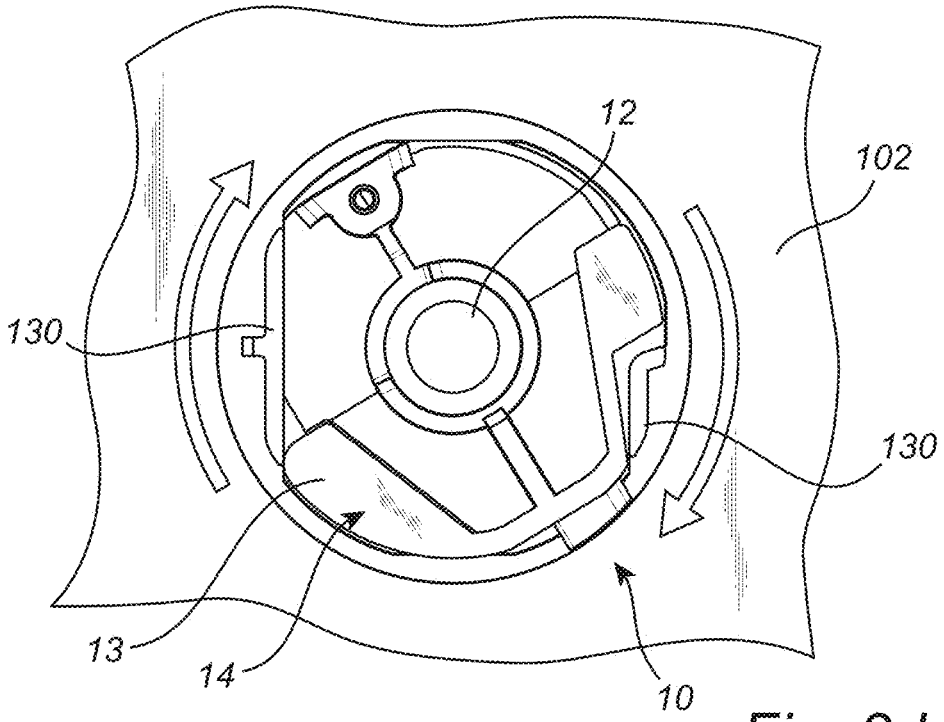
Figure 2E:
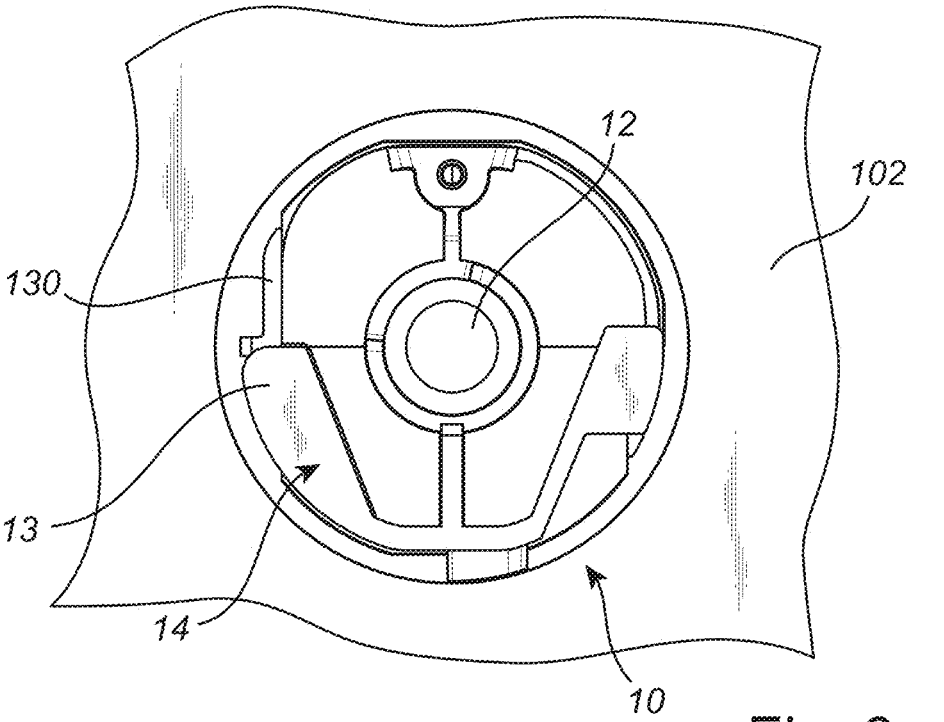

FIG. 2*d* illustrates the first part 10 when in the same predetermined intermediate position as in FIG. 2*b*, but as seen from a second side 102, being the inside of the dispenser wall 100. FIG. 2*e* illustrates the first part 10 when in the first part fixed position as in FIG. 2*c*, but as seen from the second side 102.

Purely by example, and as in the illustrated variant, the first part 10 may be such that the first part 10 is movable along the outlet axis X of the wall opening 100 in a first attachment step, only when the first part 10 assumes an angular position in relation to the outlet axis X being in a first range of angular positions about the outlet axis X.

As illustrated in FIG. 2*a* and FIG. 2*b*, the first part 10 assumes an angular position in relation to the outlet axis X being in a range of angular positions about the outlet axis X in which the protruding portions 17, 17', 17" is insertable through the wall opening 110. To this end, a contour of the protruding portions 17, 17', 17" of the first part 10 and the size and shape of the wall opening rim 120 may be adapted to each other, such that the protruding portions 17, 17', 17" are insertable into the wall opening 100 only when the first part 10 assumes an angular position in relation to the outlet axis X being in a range of angular positions about the outlet axis X. As such, in a first attachment step, the first part 10 is moved along the outlet axis X of the wall opening 110 to assume a predetermined intermediate position as illustrated in FIG. 2*b*.

Optionally, the first part 10 may be such that when in the intermediate position, the first part 10 is held in the intermediate position in relation to the wall opening rim 120 without requiring external support.

Optionally, and as in the illustrated variant, the rim attachment element 14 may be such that the first part 10 is movable from the predetermined intermediate position to the first part fixed position by rotation around the outlet axis X in a second attachment step. As illustrated in the example, the first part 10 is movable by rotation around the outlet axis X from the intermediate position illustrated in FIG. 2*b* to the first part fixed position as illustrated in FIG. 2*c*. With "by rotation" is meant herein that a part is movable by movement in a rotational direction around an axis. The rotation may extend over any number of degrees around the outlet axis, i.e. "by rotation" does not necessarily imply the part is movable by 360 degrees around an axis. For example, and as in the illustrated variant, the first part 10 may be movable from the predetermined intermediate position to the first part fixed position by rotation around the outlet axis X, where the rotation is no more than 360 degrees, such as no more than 180 degrees.

For example, and as illustrated, the rim attachment element 14 may be such that the first part 10, when in the first part position, is hindered from further rotation about the outlet axis X of the wall opening 100.

To guide the movement of the first part 10 between the initial position, the intermediate position and/or the first fixed position, different types of guide and/or retention elements may be provided. For example, such guide and/or retention elements may comprise interacting male/female part such as slots, ridges, threads and similar.

For example, the wall opening rim 120 may comprise one or more engagement members 130, and the first part 10, such as the rim attachment element 14 of the first part, may be adapted for engagement with the engagement members 130.

For example, and as illustrated in FIG. 1, the rim attachment element 14 of the first part 10 may comprises at least one tongue 13 adapted for engagement with the wall opening rim 110 when the first part 10 is in the first part fixed position. For example, the tongue 13 is adapted to engage with the wall opening rim 120 by abutment in a direction along the dispensing axis X1 of the first part 10.

For example, the wall opening rim 120 may comprise one or more engagement members 130, such as in the illustrated variant engagement members 130 in the form of ribs protruding along the outlet axis X. The engagement members 130 may for example, as in the illustrated variant, protrude along the outlet axis X in a direction towards the inside of the dispenser.

As illustrated in FIGS. 2*a* to 2*e*, the tongues 13 are arranged so as to interact with the engagement members 130 to maintain the first part 10 in the first part fixed position 10 in relation to the wall opening rim 120.

In a further example, and as illustrated in FIGS. 3*a* to 3*d*, the first part 10 and the second part 20 may be such that the second part 20 is movable by one or more attachment steps from an initial state where the second part 20 is unattached to the wall opening rimfirst part 10 to the second part fixed position.

For example, the second part 20 may be configured in relation to the first part 10 so as to be guided towards the second part fixed position during at least one of the one or more attachment steps.

Optionally, the second part 20 and the first part 10 may be such that the second part 20 is movable in a first attachment step from an initial state where the second part 20 is unattached to the first part 10 to a predetermined intermediate position at or adjacent the first part 10, and in a second attachment step from the predetermined intermediate position to the second part fixed position.

For example, the second part 20 may be configured in relation to the first part 10 so as to be guided towards the first part fixed position during the second attachment step.

Optionally, and as in the illustrated variant, the second part 20 and the first part 10 may be such that the second part 20 is movable in direction at least partly along the dispensing axis X1 of the first part 10 in the first attachment step. For example, the second part 20 may be movable in direction at least partly along the dispensing axis X1 of the first part 10 only when the second part 20 is in a first range of angular positions about the dispensing axis X1 of the first part 10.

As such, when the second part 20 is oriented with respect to the first part 10 to be outside of the range of angular positions about the dispensing axis X1 of the first part 10, the second part 20 may be hindered from movement along the dispensing axis X1 to the predetermined intermediate position.

For example, and as in the illustrated variant as seen in FIG. 1, the second part 20 may be provided with a protruding portion 25, fitting towards a cut out 15 in a protruding portion 17' of the first part 10. As such, only when the second part 20 is within a range of angular positions about the dispensing axis X1 of the first part 10, the protruding portion 25 of the second part 20 can be received in the cut out 15 such that the second part 20 may be approached to the first part 10 in a direction along the dispensing axis X1 of the first part 10.

Figure 3A:
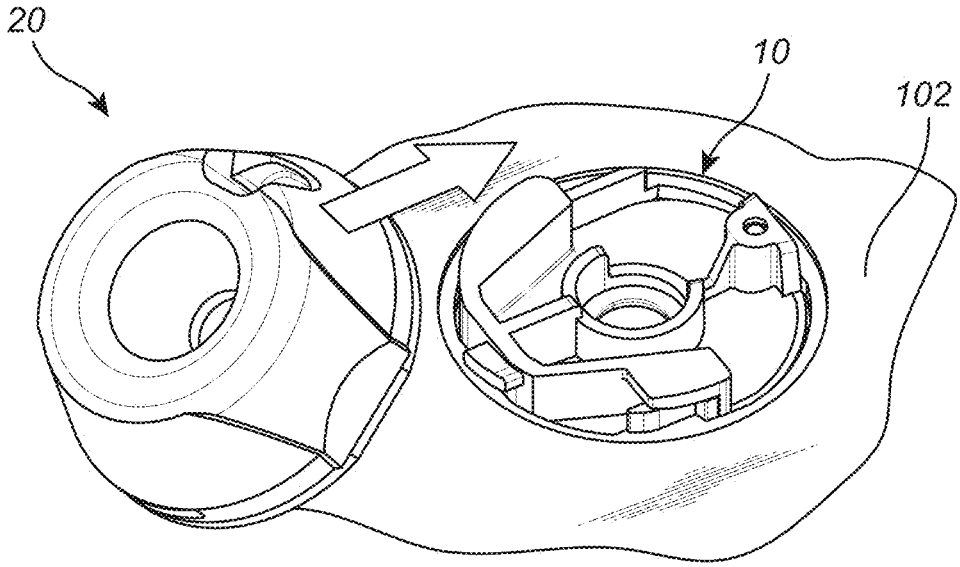
FIGS. 3*a* to 3*d* illustrate the attachment of a second part 20 of FIG. 1 to a first part 10 of FIG. 1, the first part 10 being attached to the wall opening rim 120 of a wall opening 110 in a wall 100 of a dispenser.
Figure 3B:
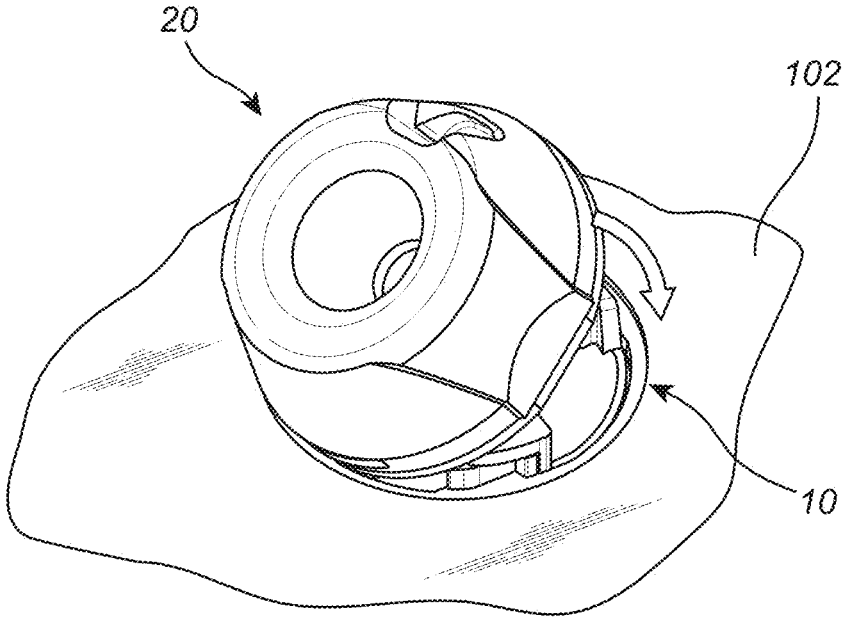
Figure 3C:
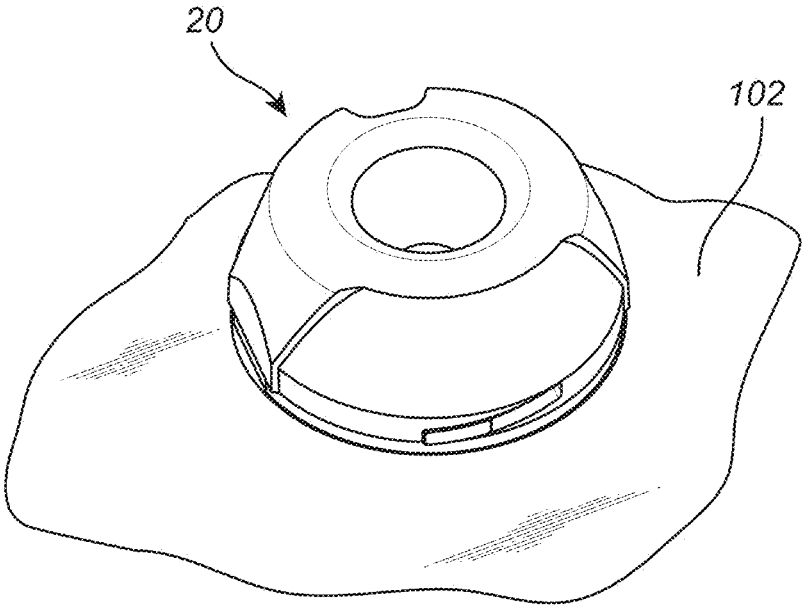
Figure 3D:
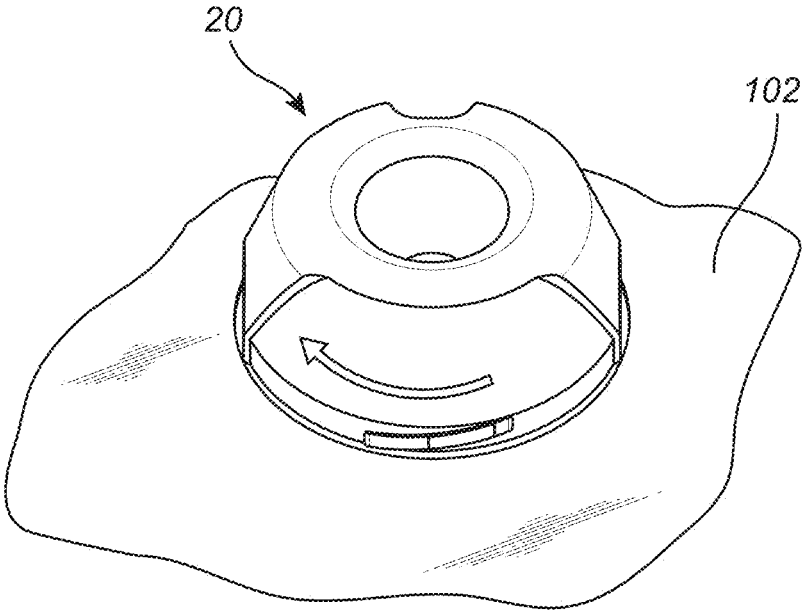

FIG. 3*a* illustrates the second part 20 of the example variant of an outlet assembly 1 of FIG. 1 when in an initial position unattached to the first part 10, as shown from second side 102 being an inside of the dispenser wall 100. FIG. 3*b* illustrates the step of moving the second part 20 from the initial position to a predetermined intermediate position at the first part 10. FIG. 3*c* illustrates the second part 20 when in the predetermined intermediate position. FIG. 3*d* illustrates the second part 20 when in the second part fixed position relative to the first part 10.

For example, and as in the illustrated variant as seen in FIGS. 3*a* to 3*c*, the second part 20 is movable in a direction at least partly along the axis X in relation to the first part 10 by being pivoted about a pivot axis perpendicular to the dispensing axis X1 of the first part 10.

Optionally, the second part 20 and the first part 10 may be such that when the second part 20 is in the predetermined intermediate position, the second part 10 is held in the predetermined intermediate position in relation to the wall opening rim 120 without requiring external support.

Optionally, and as in the illustrated variant as seen in FIGS. 3*c* to 3*d*, the first part 10 and the second part 20 are such that the second part 20 is movable from the predetermined intermediate position to the second part fixed position by rotation of the second part 20 about the dispensing axis X1 of the first part 10. For example, and as in the illustrated variant, the second part 20 is movable from the predetermined intermediate position to the second part fixed position by rotation of the second part 20 about the dispensing axis X1 of the first part 10, where the rotation is no more than 180 degrees, such as no more than 90 degrees.

For example, and as illustrated, the first part 10 and the second part 20 may be such that the second part 20, when in the second part fixed position, is hindered from further rotation about dispensing axis X1 of the first part 10.

Optionally, the first connector element 16 and the second connector element 26 are adapted to engage by abutment in a direction along the dispensing axis X1 of the first part 10, when the second part 20 is in the second part fixed position in relation to the first part 10.

For example, and as in the illustrated embodiment as seen in FIG. 1, the first connector element 16 may comprise a groove and the second connector element 26 may comprise a protruding rib. For example, movement from the predetermined intermediate position to the second part fixed position by rotation of the second part 20 about the dispensing axis X1 of the first part 10 may imply that the protruding rib is brought along the groove until the second part fixed position is reached.

However, it is to be understood, that numerous options are available for forming e.g. the first connector element 16 and the second connector element 26, using mechanical connection means such as grooves, protrusions, threads etc.

In a second aspect of the invention, there is provided an outlet assembly as described in the above, comprising at least a first part and at least two second parts, wherein the second outlet portions of the two second parts differ from each other. As such, the first part may be connected with any one of the at least two second parts to form a desired outlet assembly.

The second outlet portions of the two second parts differ from each other. As such, the second outlet portions may differ e.g. in size or shape.

For example, one of the second outlet portions may define a conical outlet path, and the other of the second outlet portions may define a cylindrical outlet path.

For example, both of the second outlet portions may define a conical outlet path, but the one and the other of the second outlet portions may differ e.g. in the length of the conical outlet path, the diameter of one or both of the ends of the conical outlet path, and/or the angle of the conical outlet path.

As such, the two second parts may provide for different types of dispensing of web-shaped absorbent material from the dispenser.

For example, one of the second parts may be adapted for use when a first web-shaped material is arranged in the dispenser, and the other of the second parts may be adapted for use when a second web-shaped material, being different from the first web-shaped material is arranged in the dispenser.

Optionally, the second outlet portion of a first of the second parts is adapted for one-by-one dispensing of web-shaped absorbent material, and the second outlet portion of a second of the second parts is adapted for continuous dispensing of the web-shaped absorbent material, i.e free flow dispensing.

In a third aspect there is provided a dispenser 1000 comprising an outer wall 100 defining an outer wall opening 110 extending along and outlet axis X through the wall, and having a wall opening rim 120, the dispenser further comprising an outlet assembly 1 as described in the above.

Purely as an example, such a dispenser 1000 is illustrated in FIG. 4*a* in an open state, and in FIG. 4*b* in a closed state. The example dispenser 1000 comprises an example outlet assembly 1 as illustrated in FIGS. 1 to 3. As seen in FIG. 4*a*, the second part 2 comprising a nozzle portion 28 comprising the second outlet portion 22 is arranged from the inside 102 of the dispenser wall 100. As seen in FIG. 4*b*, the first part 10 comprising the first outlet portion 12 is arranged from the outside 101 of the dispenser wall 100. Moreover, the wall portion 18 of the first part 10 is seen to conform to the outer surface on the outside 101 of the dispenser 1.

For example, and as illustrated in the dispenser 1000 of FIGS. 4*a* to 4*b*, dispenser may comprise a cover portion, and the outlet assembly 1 may be arranged to the dispenser wall 100 of the cover portion.

It will be understood that the outlet assembly 1 as described herein may be used with a wide range of dispensers. For example, the dispenser may be a dispenser adapted to dispense web-shaped absorbent material from a centre-feed roll of web-shaped absorbent material. For example, the dispenser may be a dispenser adapted for manual dispensing, i.e. where the web-shaped absorbent material is dispensed by a user pulling a tail of the web-shaped material protruding from the dispensing opening of the dispenser.

For completeness, as already outlined in the above, and described in relation to the example of FIGS. 2 and 3, in a fourth aspect there is provided a method for arranging an outlet assembly according to the first aspect to an outer wall 100 of a dispenser 1000 for web-shaped absorbent material, the outer wall 100 defining a wall opening 110 extending along an outlet axis X through the wall 100, and the wall opening 110 having a wall opening rim 120, the method comprising:

Moving the first part 10 from an initial state unattached to the wall opening rim 120 to the first part fixed position in relation to the wall opening rim 120 by one or more attachments steps; and Moving the second part 20 from an initial state unattached to the first part 10 to the second part fixed position in relation to the first part 10 by one or more attachment steps.

Optionally, the method may further comprise the step of fastening the first part 10 and the second part 10 in the first and second part fixed positions using a fastening member.

When the first part 10 and the second part 20 comprises respective fastening bores 19, 29, the fastening member may be introduced in the aligned fastening bores 19, 29.

Optionally, the step of moving the first part 10 from an initial state unattached to the wall opening rim 120 to the first part fixed position comprises A first attachment step comprising moving the first part 10 from the initial state to a predetermined intermediate position adjacent or at the wall opening rim 120; and A second attachment step comprising moving the first part 10 from the predetermined intermediate position to the first part fixed position.

Optionally, the step of moving the second part 20 from an initial state unattached to the first part 10 to the first part fixed position comprises A first attachment step comprising moving the second part 20 from the initial state to a predetermined intermediate position adjacent or at first part 10; and A second attachment step comprising moving the second part 20 from the predetermined intermediate position to the first part fixed position.

Optionally, each of the first attachment step and the second attachment step as mentioned in the options in the above may be performed by movements of the first part 10 or the second parts 20 in different directions. For example, if the first attachments step is performed by moving the relevant part in a translational movement along a direction, the second attachment step may comprise moving the relevant part in a translational movement along another direction, or by a rotational or pivotal movement.

It is to be understood that the present invention is not limited to the embodiments described above and illustrated in the drawings; rather, the skilled person will recognize that many changes and modifications may be made within the scope of the appended claims.

The invention claimed is:

1. An outlet assembly for arrangement to an outer wall of a dispenser for web-shaped absorbent material, the outer wall defining a wall opening extending along an outlet axis through the wall, the wall opening having a wall opening rim, and the outlet assembly being adapted to form an outlet for dispensing of the web-shaped absorbent material from the dispenser through the wall opening in a direction along the outlet axis, wherein the outlet assembly comprises a first part defining a first outlet portion extending along a dispensing axis of the first part;

and a second part defining a second outlet portion extending along a dispensing axis of the second part;

wherein the first part comprises a rim attachment element being such that the first part can be attached to the wall opening rim by means of the rim attachment element such that the first part assumes a first part fixed position in relation to the wall opening outer rim, wherein the dispensing axis of the first outlet portion extends along the outlet axis, and the first part further comprises a first connector element, and the second part comprises a second connector element, the first connector element and the second connector element being such that the second part can be attached to the first part when in the first part fixed position by means of connection between the first connector element and the second connector element, such that the second part assumes a second part fixed position in relation to the first part, wherein the dispensing axis of the second outlet portion extends along the dispensing axis of the first outlet portion, such that, when the first part is in the first part fixed position in relation to the wall opening rim, and the second part is in the second part fixed position in relation to the first part, the first outlet portion and the second outlet portion form the outlet for dispensing of the web-shaped absorbent material from the dispenser through the wall opening in a direction along the outlet axis, wherein the first part and the second part are such that the second part is movable by one or more attachment steps from an initial state, where the second part is unattached to the first part, to the second part fixed position, wherein the second part and the first part are such that the second part is movable in a first attachment step from an initial state where the second part is unattached to the first part to a predetermined intermediate position at or adjacent the first part, and in a second attachment step from the predetermined intermediate position to the second part fixed position, wherein the first part and the second part are such that the second part is movable from the predetermined intermediate position to the second part fixed position by rotation of the second part about a centre axis of the first part.

2. The outlet assembly according to claim 1, wherein the dispenser wall has a first side and a second side opposite the first side, and wherein the rim attachment element is such that the first part can be brought to the first part fixed position from the first side of the dispenser wall, and the first and second connector elements are such that the second part can be brought to the second part fixed position from the second side of the dispenser wall.

3. The outlet assembly according to claim 1, wherein the first part and the second part are such that, when the first part is in the first part fixed position in relation to the wall opening rim, and the second part is in the second part fixed position in relation to the first part, at least a portion of the wall opening rim is positioned between the first part and the second part.

4. The outlet assembly according to claim 1, wherein the first part comprises a first fastening bore extending in a direction along the dispensing axis of the first part, and the second part comprises a second fastening bore extending in a direction along the dispensing axis of the second part, and, when the second part is in the second part fixed position, the first and second fastening bores are aligned in a direction along the dispensing axes of the first and second parts, allowing insertion of a fastening member though the first and second fastening bores.

5. The outlet assembly according to claim 1 wherein the first part further comprises a bracket member extending about the second outlet portion in a length direction and in a width direction, the length direction and the width direction being perpendicular to the dispensing axis of the first part.

6. The outlet assembly according to claim 5, wherein the bracket member is adapted to extend in the length direction and the width direction so as extend over at least a part of the wall opening rim, such as the entire wall opening rim, when the first part is in the first part fixed position.

7. The outlet assembly according to claim 5, wherein the first part defines one or more protruding portions protruding in a direction along the dispensing axis of the first part from the bracket member, wherein the one or more protruding portions comprises the rim attachment element and/or the first connector element, and/or a first fastening bore.

8. The outlet assembly according to claim 5, wherein the first part is configured such that the bracket member is adapted to be arranged on the first side of the dispenser wall being an outside of the dispenser wall.

9. The outlet assembly according to claim 1, wherein the second part comprises a nozzle portion forming the second outlet portion.

10. The outlet assembly according to claim 9, wherein the second part is configured such that the nozzle portion is adapted to be arranged on the second side of the dispenser wall being an inside of the dispenser wall.

11. The outlet assembly according to claim 1, wherein the first part is such that the first part is movable by one or more attachment steps from an initial state where the first part is unattached to the wall opening rim to the first part fixed position.

12. The outlet assembly according to claim 11, wherein the first part is such that the first part is movable in a first attachment step from an initial state where the first part is unattached to the wall opening rim to a predetermined intermediate position at or adjacent the wall opening rim, and in a second attachment step from the predetermined intermediate position to the first part fixed position.

13. The outlet assembly according to claim 12, wherein the first part is such that, in the first attachment step, the first part is movable along the outlet axis only when the first part assumes an angular position in relation to the outlet axis being in a first range of angular position(s) about the outlet axis.

14. The outlet assembly according to claim 12, wherein the rim attachment element is such that, in the second attachment step, the first part is movable from the predetermined intermediate position to the first part fixed position by rotation around the outlet axis.

15. The outlet assembly according to claim 1, wherein the wall opening rim comprises engagement members and the rim attachment element is adapted for engagement with the engagement members.

16. The outlet assembly according to claim 1, wherein the second part and the first part are such that, in a first attachment step, the second part is movable in direction at least partly along the dispensing axis of the first part only when the second part is in a first range of angular positions about the dispensing axis of the first part.

17. The outlet assembly according to claim 1, wherein the first connector element and the second connector element are adapted to engage by abutment in a direction along the dispensing axis of the first part, when the second part is in the second part fixed position in relation to the first part.

18. A kit for an outlet assembly comprising at least one first part and at least two second parts, wherein each of said two second parts is attachable to the one first part so as to form an outlet assembly according to claim 1, wherein the second outlet portions of the two second parts differ from each other.

19. The kit according to claim 18, wherein the second outlet portion of one of the second parts is adapted for one-by-one dispensing of web-shaped absorbent material, and the second outlet portion of another of the second parts is adapted for uninterrupted dispensing of the same web-shaped absorbent material.

20. A dispenser comprising:

an outlet assembly according to claim 1; and the outer wall, the outer wall defining the wall opening extending along the outlet axis through the outer wall, the wall opening having the wall opening rim.

21. The dispenser according to claim 20, further comprising a storage compartment housing a supply of the web-shaped absorbent material, wherein the outlet assembly form the outlet for dispensing of the web-shaped absorbent material from the dispenser through the wall opening in a direction along the outlet axis.

22. A method for arranging an outlet assembly according to claim 1 to the outer wall of the dispenser for web-shaped absorbent material, the outer wall defining the wall opening extending along the outlet axis through the outer wall, and the wall opening having the wall opening rim, the method comprising:

moving the first part from an initial state unattached to the wall opening rim to the first part fixed position in relation to the wall opening rim by one or more attachments steps; and moving the second part from an initial state unattached to the first part to the second part fixed position in relation to the first part by one or more attachment steps.

23. The method according to claim 22, comprising the step of fastening the first part and the second part when in the first and second part fixed positions, respectively, using a fastening member.

24. The method according to claim 22, wherein the step of moving the first part from an initial state unattached to the wall opening rim to the first part fixed position comprises a first attachment step comprising moving the first part from the initial state to a predetermined intermediate position adjacent or at the wall opening rim; and a second attachment step comprising moving the first part from the predetermined intermediate position to the first part fixed position.

25. The method according to claim 22, wherein the step of moving the second part from an initial state unattached to the first part to the first part fixed position comprises a first attachment step comprising moving the second part from the initial state to a predetermined intermediate position adjacent or at first part by a first movement in at least a first direction; and a second attachment step comprising moving the second part from the predetermined intermediate position to the first part fixed position by a second movement in at least a second direction, different from the first direction.

* * * * *